US011735845B2

(12) United States Patent
Gietzold et al.

(10) Patent No.: US 11,735,845 B2
(45) Date of Patent: Aug. 22, 2023

(54) POWER CONNECTOR

(71) Applicant: HS Elektronik Systeme, GmbH, Noerdlingen (DE)

(72) Inventors: Thomas Gietzold, Baden-Wuerttemberg (DE); Alois Wuensch, Megesheim (DE)

(73) Assignee: HS ELEKTRONIK SYSTEME, GMBH, Noerdlingen (DE)

( * ) Notice: Subject to any disclaimer, the term of this patent is extended or adjusted under 35 U.S.C. 154(b) by 30 days.

(21) Appl. No.: 17/198,431

(22) Filed: Mar. 11, 2021

(65) Prior Publication Data

US 2021/0288419 A1 Sep. 16, 2021

(30) Foreign Application Priority Data

Mar. 13, 2020 (EP) ..... 20163028

(51) Int. Cl.

| | |
|---|---|
| ***H01R 12/70*** | (2011.01) |
| ***H01R 12/72*** | (2011.01) |
| ***H01R 12/73*** | (2011.01) |
| ***H01R 13/17*** | (2006.01) |

(52) U.S. Cl.

CPC ..... *H01R 12/7058* (2013.01); *H01R 12/727* (2013.01); *H01R 12/732* (2013.01); *H01R 13/17* (2013.01); *H01R 2201/26* (2013.01)

(58) Field of Classification Search

CPC ..... H01R 12/7058; H01R 12/727; H01R 12/732; H01R 13/17; H01R 2201/26; H01R 11/03; H01R 25/162; H01R 4/30; H01R 13/111; H01R 12/7088; H01R 13/187

See application file for complete search history.

(56) References Cited

U.S. PATENT DOCUMENTS

| | | | | |
|---|---|---|---|---|
| 4,632,496 | A * | 12/1986 | Williams | H01R 13/187 439/654 |
| 6,036,508 | A * | 3/2000 | Anderson | H01R 12/721 439/80 |
| 6,062,914 | A | 5/2000 | Fasano | |
| 6,560,123 | B1 | 5/2003 | De Varennes et al. | |
| 6,618,268 | B2 | 9/2003 | Dibene, II et al. | |
| 7,322,858 | B1 * | 1/2008 | Rogers | H01R 24/58 439/669 |
| 10,535,934 | B1 | 1/2020 | Hassanzadeh et al. | |
| 10,622,771 | B2 * | 4/2020 | Yang | H01R 25/161 |
| 2017/0256873 | A1 | 9/2017 | Knop | |
| 2018/0123301 | A1 | 5/2018 | Tsukamoto | |

FOREIGN PATENT DOCUMENTS

| | | |
|---|---|---|
| EP | 3264436 A1 | 1/2018 |
| EP | 3621421 A1 | 3/2020 |
| WO | 2011064640 A1 | 6/2011 |

OTHER PUBLICATIONS

Extended European Search Report for International Application No. 20163028.2 dated Aug. 8, 2020, 11 pages.

* cited by examiner

*Primary Examiner* — Travis S Chambers
(74) *Attorney, Agent, or Firm* — Cantor Colburn LLP

(57) ABSTRACT

A power connector for an aircraft solid state power controller includes a first portion including a socket configured for receiving an electric plug, which is inserted into the socket in a receiving direction (R). The controller also includes a second portion comprising a connection surface configured for mating with a complementary connection surface of a complementary connection element. At least one opening is formed within the connection surface.

14 Claims, 6 Drawing Sheets

POWER CONNECTOR

FOREIGN PRIORITY

This application claims priority to European Patent Application No. 20163028.2 filed Mar. 13, 2020, the entire contents of which is incorporated herein by reference.

TECHNICAL FIELD

The invention relates to a power connector for an aircraft controller, in particular for an aircraft solid state power controller, and to an aircraft solid state power controller comprising such a power connector.

BACKGROUND

Aircraft power controllers need to handle and distribute comparatively large electric currents up to several hundreds of Amperes.

It therefore is desirable to provide an efficient power connector for delivering and distributing said large electric currents, which is easy to produce and employ.

BRIEF DESCRIPTION

According to an exemplary embodiment of the invention, a power connector for an aircraft solid state power controller comprises a first portion including a socket configured for receiving an electric plug, which is insertable into the socket in a receiving direction, and a second portion comprising a connection surface configured for mating with a complementary connection surface of a complementary connection element. At least one opening is formed within the connection surface.

Exemplary embodiments of the invention further include a power connection assembly comprising a power connector according to an exemplary embodiment of the invention, and a complementary connection element with a complementary connection surface, which is configured for mating with the connection surface formed at the second portion of the power connector.

Exemplary embodiments of the invention also include an electric circuit board, in particular a printed circuit board, comprising a power connector according to an exemplary embodiment of the invention. An aircraft solid state power controller may be formed on the electric circuit board.

A power connection assembly comprising a power connector according to an exemplary embodiment of the invention provides an efficient distribution platform or system for electric current. A power connector according to an exemplary embodiment of the invention may be produced with only little machining. Power connectors according to exemplary embodiments of the invention may be provided in different shapes.

Nevertheless, the power connectors may be standardized, particularly with respect to providing the first portion with a standardized socket configured for receiving an electric plug according to any desired electric standard, and/or with respect to providing the second portion with a standardized connection surface. In this way the connection surface has a standardized layout and is thus configured for mating with a complementary connection surface of complementary connection elements having any desired configuration. One and the same power connector can thus be used for mating with a great variety of different complementary connections elements. This allows for an easy integration of the power connectors into the manufacturing process of the power controllers.

Particular embodiments may include any of the following optional features, alone or in combination with other features:

The connection surface of the power connector may be a flat connection surface. A surface normal of the connection surface may in particular extend orthogonally to the receiving direction. Such a configuration of the connection surface may be produced easily needing only simple machining, and it may be efficiently and conveniently paired with a complementary connection surface of a complementary connection element for providing a reliable and potent electric connection between the power connector and the complementary connection element.

For enhancing the efficiency of the production of the power connector even further, the first and second portions of the power connector may be formed integrally with each other.

However, if it is considered beneficial under specific circumstances, the first and second portions of the power connector may be produced independently from each other and joined later for forming the power connector.

At least one opening may extend between the connection surface and a lower surface of the power connector. Connection elements, such as bolts and/or screws, may extend through said openings for fixing the complementary connection element to the power connector and/or for fixing the power connector to a printed circuit board.

At least one protrusion may extend from the connection surface. At least one corresponding opening, which is configured for receiving the at least one protrusion, may be formed in the complementary connection surface of the complementary connection element. The combination of at least one protrusion extending from the connection surface and a corresponding opening formed in the complementary connection surface allows for securing a correct alignment of the complementary connection element with respect to the power connector.

The power connector may comprise a connection channel extending between the socket, in particular a silver covered end portion of the socket, and the lower surface of the power connector. At least one electric connector may be arranged within the connection channel for providing an efficient electric connection between the plug, when it is inserted into the opening, and an electric contact contacting the electric connector at the lower surface of the power connector.

The at least one electric connector may include a metallic spring, in particular a helical spring. The elasticity of a spring results in a reliable mechanical and electric connection between the at least one electric connector and a corresponding contact portion of the plug and/or an electric contact contacting the electric connector at the lower surface of the power connector.

The first portion may have a first upper surface and a first lower surface, wherein the first lower surface is arranged parallel and opposite to the first upper surface. A first distance between the first upper surface and the first lower surface may be larger than a second distance between the connection surface and the lower surface. Such a configuration results in a step formed on the upper surface of the power connector, providing enough space of accommodating a plug in the first portion of the power connector and simultaneously proving a flat second portion for receiving the complementary connection surface of the complementary connection element. Such a configuration reduces the height/thickness of the power connector allowing for a slim design of the power controller.

In a plane oriented orthogonally to the receiving direction, the first portion may have a rectangular cross-section, in particular a quadratic cross-section. Alternatively, the first portion may have a circular cross-section. Rectangular and quadratic cross-sections are well-suited for receiving correspondingly shaped plugs.

The connection surface and the complementary connection surface may extend in a direction parallel, or essentially parallel, to the printed circuit board. Thus results in a flat configuration of the power connection assembly.

BRIEF DESCRIPTION OF THE DRAWINGS

The subject-matter regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
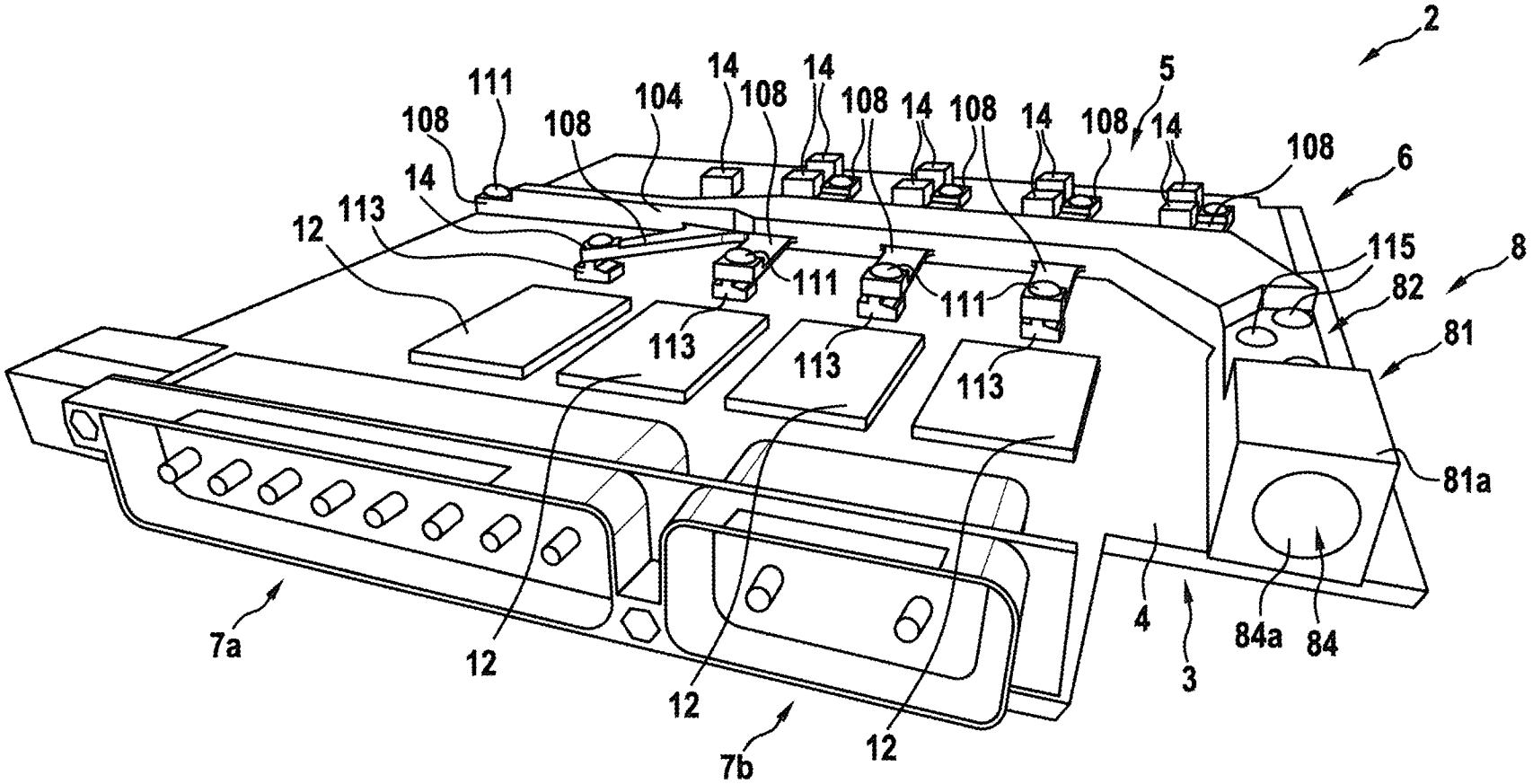
FIG. 1 shows a perspective view of a solid state power controller comprising a power connector according to an exemplary embodiment of the invention.
Figure 2:
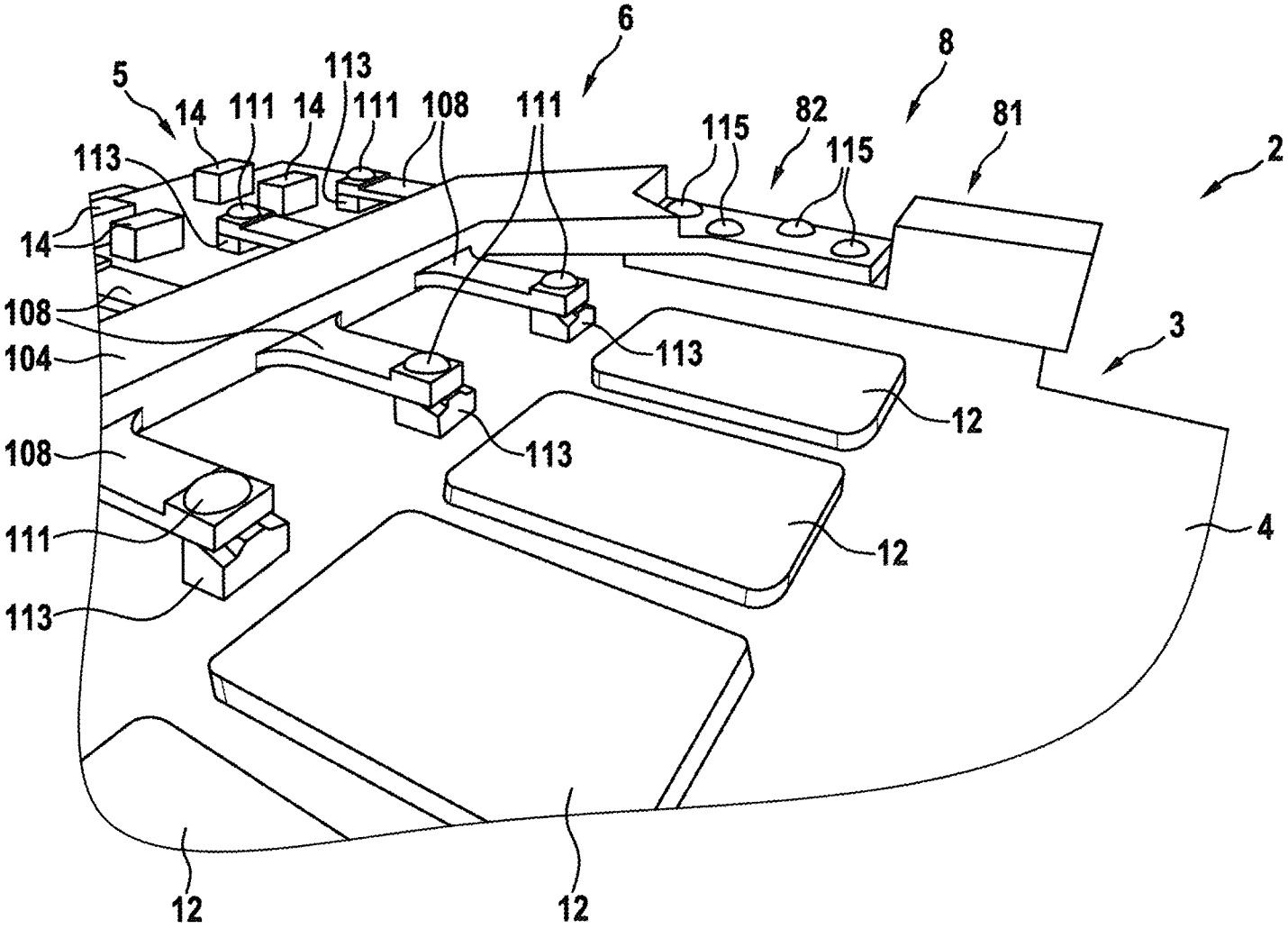
FIG. 2 shows an enlarged detail of the solid state power controller depicted in FIG. 1 from a different perspective.

FIG. 1 shows an perspective view of a solid state power controller 2 comprising a power connector 8 according to an exemplary embodiment of the invention. FIG. 2 shows an enlarged detail of the solid state power controller 2 from a different perspective.

The solid state power controller 2 comprises a plurality of high performance solid state switches 12 forming a high performance portion 3 of the power controller 2, which is shown in the front portion of FIGS. 1 and 2. The high performance solid state switches 12 may be capable to switch electric currents of several hundreds of Amperes.

The solid state power controller 2 further comprises a plurality of control circuits 14 forming a (low current) control portion 5 of the power controller 2, which is shown in a rear portion of FIGS. 1 and 2, respectively. The electric currents flowing in the control portion 5 of the power controller 2 are usually considerably smaller than the electric currents flowing in the high performance portion 3 of the power controller 2. Electric currents flowing in the control portion 5 of the power controller 2 normally do not exceed 10 Amperes.

Outputs of the high performance solid state switches 12 are connected to output connectors 7*a*, 7*b* shown in the front of FIG. 1 for supplying controlled electric power to electric consumers (not shown).

The solid state switches 12, the control circuits 14 and the output connectors 7*a*, 7*b* are mounted to a common circuit board 4, in particular a printed circuit board (PCB). The common circuit board 4 comprises a plurality of conducting paths 42 (cf. FIG. 7) establishing the desired electric connections between the different electric components 12, 14 mounted to the circuit board 4.

The solid state power controller 2 also comprises a power connection assembly 6, which is also mounted to the circuit board 4 and configured for distributing electric power input into the power controller 2 to the electric components 12, 14 mounted to the circuit board 4, in particular to the solid state switches 12 and the control circuits 14.

The power connection assembly 6 comprises a power connector 8 and a complementary connection element 10, which is mechanically and electrically connected with the power connection assembly 6.

The power connector 8 is shown in the right front edge of the circuit board 4 in FIG. 1 and in the rear right edge of the circuit board 4 in FIG. 2.

Figure 3:
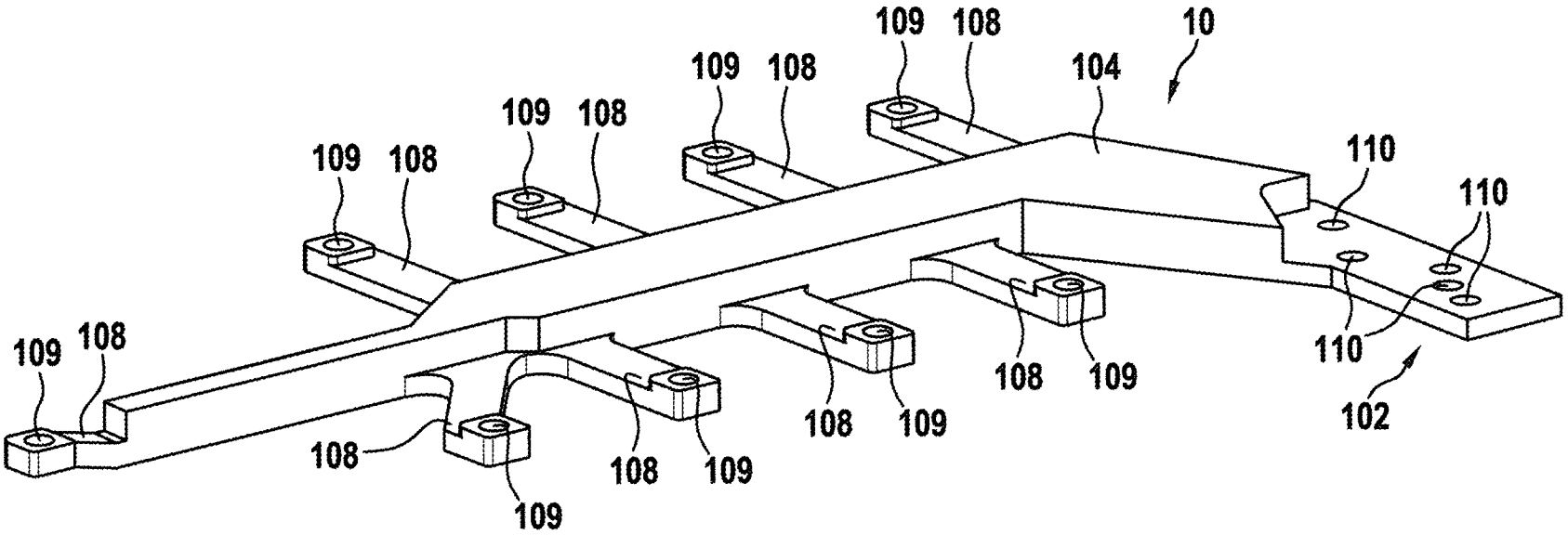
FIG. 3 shows a perspective view of a complementary connection element according to an exemplary embodiment of the invention.

FIG. 3 shows a perspective view of an complementary connection element 10, which may be mounted to a power connector 8 according to an exemplary embodiment of the invention.

Figure 5:
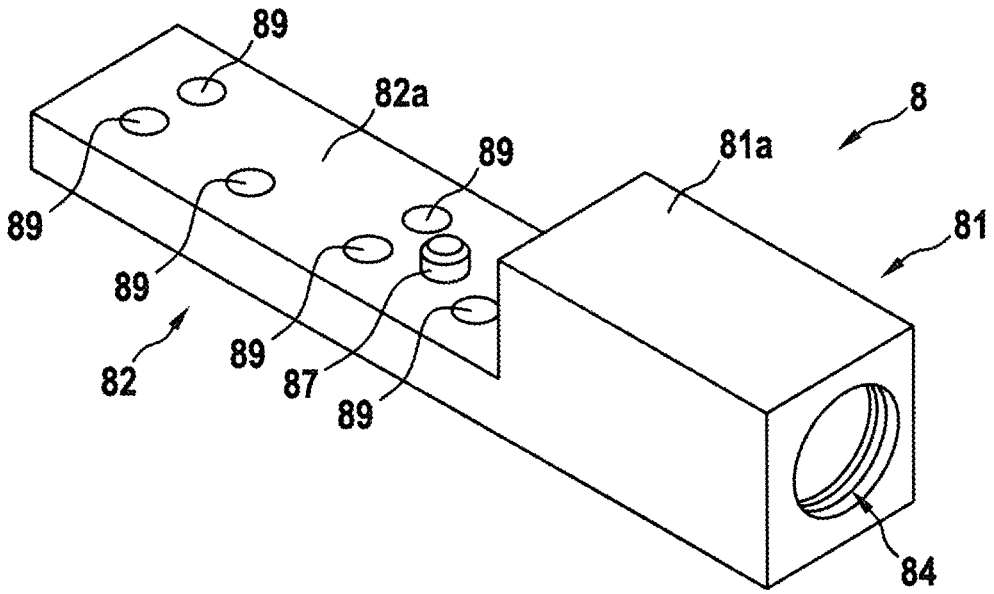
FIG. 5 shows a perspective upper view of the power connector shown in FIG. 4.

The complementary connection element 10 comprises a complementary connection surface 102, which, in the orientation depicted in FIG. 3 faces to the bottom, and which is configured for mating with a corresponding connection surface 82*a* formed at the power connector 8 (cf. FIG. 5).

The complementary connection element 10 further comprises a backbone 104 which is electrically connected with the complementary connection surface 102. In the configuration shown in the figures the backbone 104 extends at an angle, particularly basically orthogonally, with respect to the complementary connection surface 102, but other configurations of the backbone 104 are conceivable as well. A plurality of connection arms 108 extend from the backbone 104 for distributing electric power from the power connector 8 via the complementary connection surface 102 to the solid state switches 12 and control circuits 14 (cf. FIG. 1). In the configuration shown, most of the connection arms 108 extend basically orthogonally from both sides of the backbone 104. An additional connection arm 108 extends from an end of the backbone 104 opposite to the complementary connection surface 102 in extension of the backbone 104. Other configuration of the connections arms 108 are conceivable.

An opening 109 is formed in each of the connection arms 108, respectively, allowing fixing elements 111, such as bolts or screws, to extend through the connection arms 108 for securely fixing the connection arms 108 to corresponding electric contacts 113 provided on the circuit board 4 (see FIGS. 1 and 2).

Figure 4:
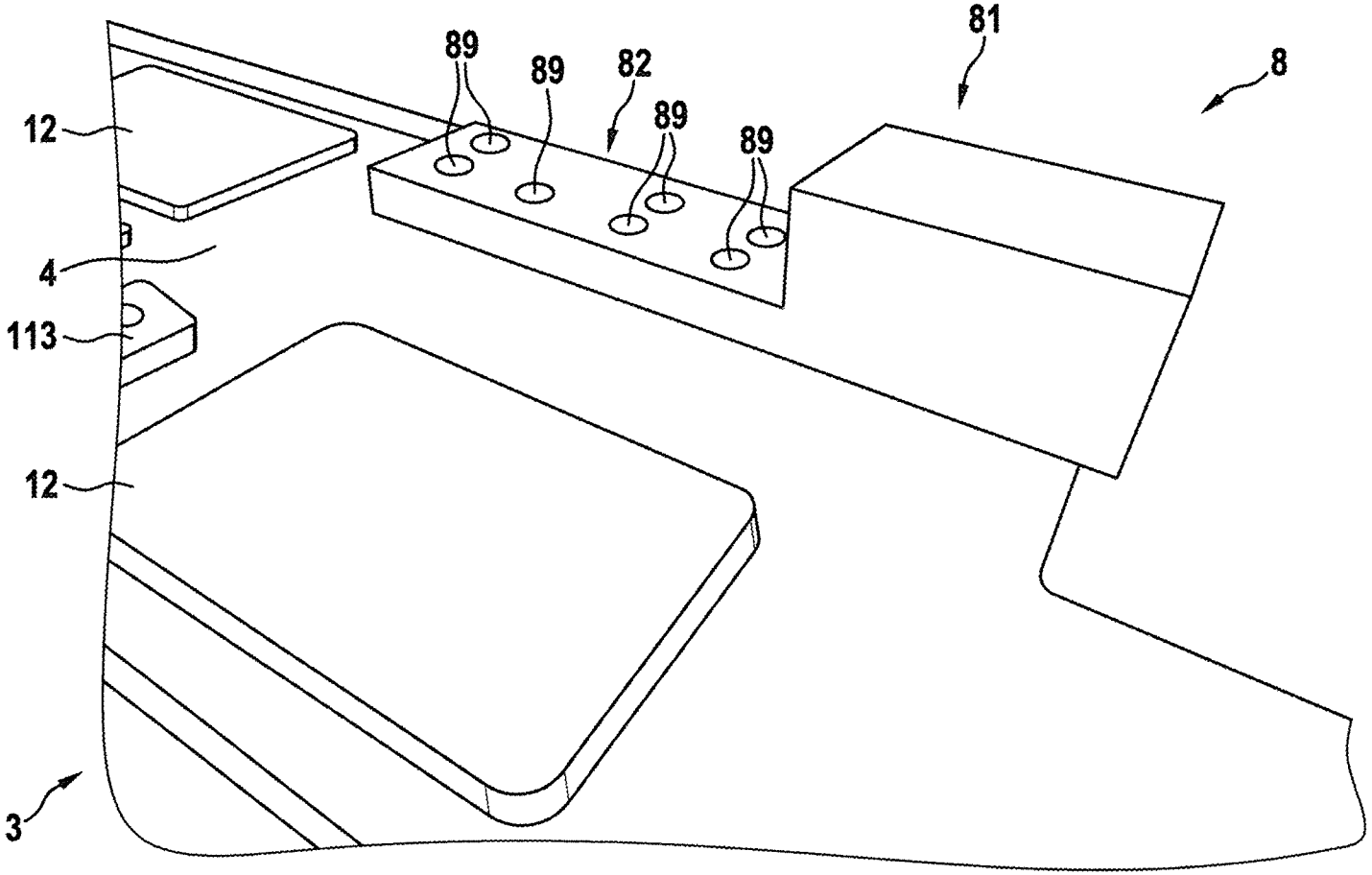
FIG. 4 shows an enlarged perspective view of a power connector according to an exemplary embodiment of the invention without the complementary connection element.
Figure 6:
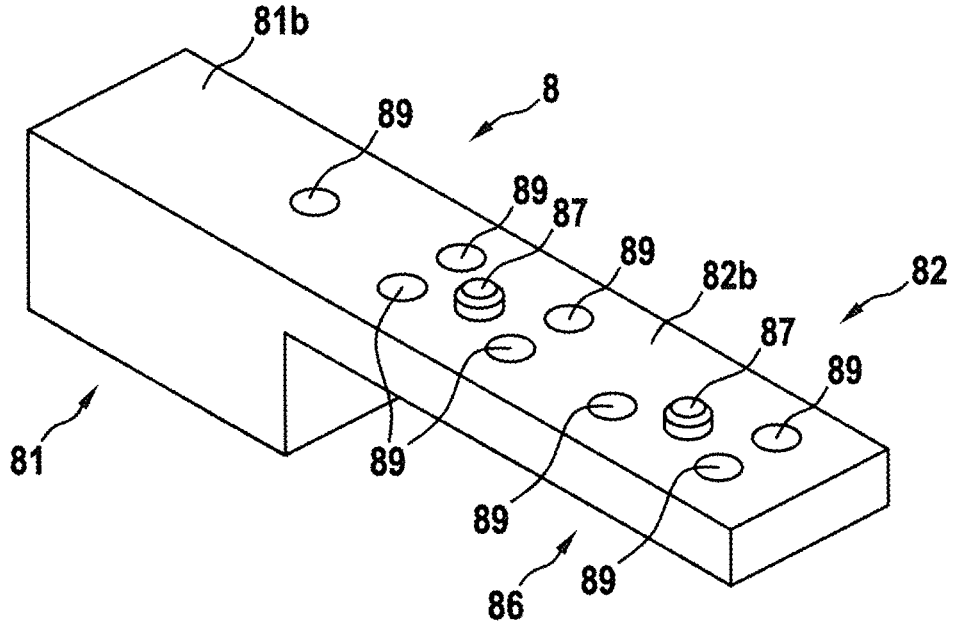
FIG. 6 shows the power connector shown in FIGS. 4 and 5 from below.

FIG. 4 shows an enlarged perspective view of the power connector 8 on the circuit board 4 without the complementary connection element 10. FIG. 5 shows the power connector 8 separated from the circuit board 4; FIG. 6 depicts the power connector 8 shown in FIG. 5 from below; and FIG. 7 depicts a sectional side view of said power connector 8.

The power connector 8 comprises a first portion 81 having a first upper surface 81*a* and a first lower surface 81*b*, which is arranged opposite and parallel to the first upper surface 81*a* in a distance $d_1$.

An opening providing a socket 84 is formed in an end face of the first portion 81. When the power connector 8 is mounted to the circuit board 4, the end face extends orthogonally to the plane of the circuit board 4.

Figure 7:
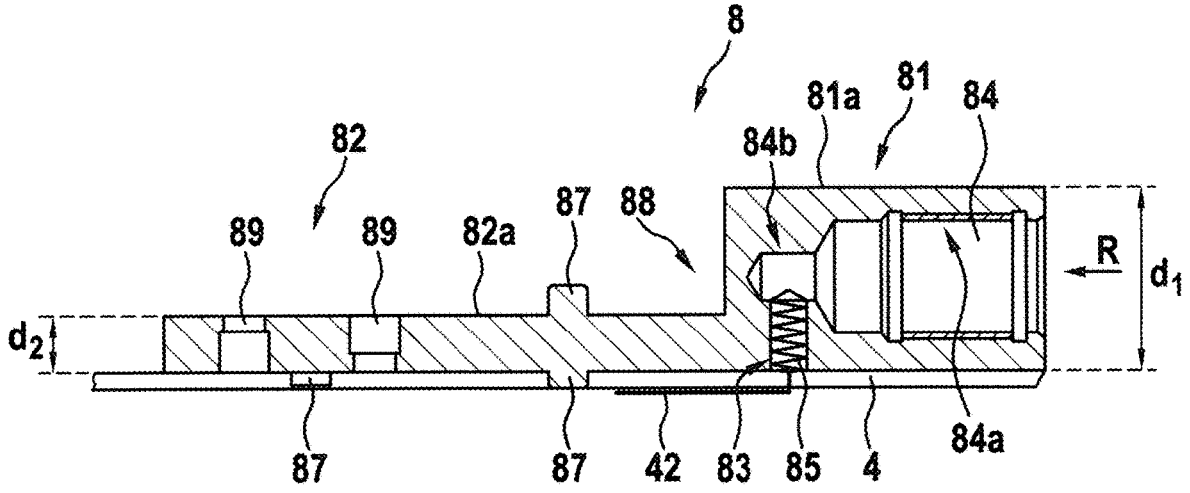
FIG. 7 shows a cross sectional side view of the power connector shown in FIGS. 4 to 6.
Figure 8:
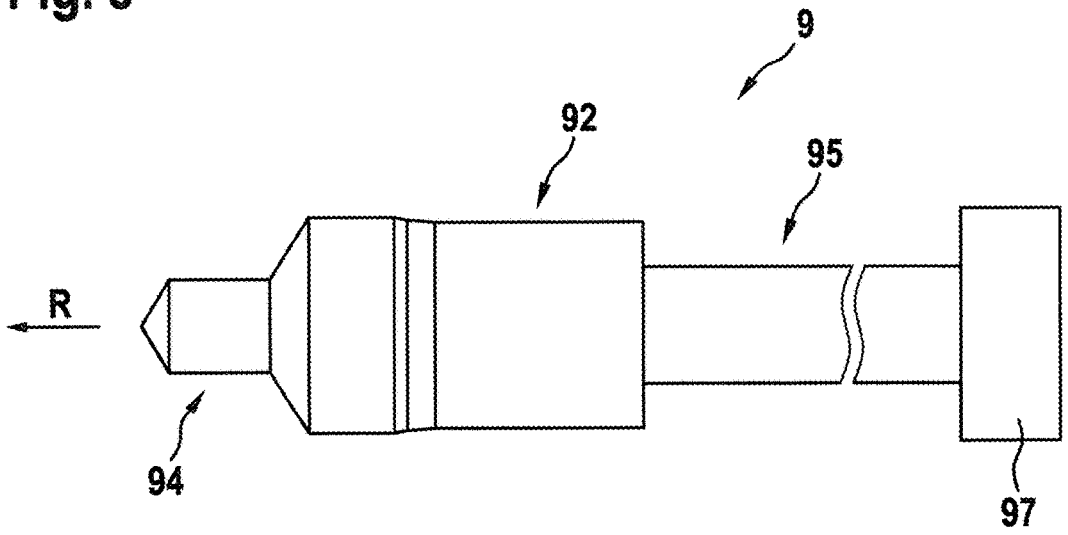
FIG. 8 shows a side view of a power plug configured for being inserted into the socket of the power connector shown in FIGS. 4 to 7.

The socket 84 is configured for receiving an electric plug 9, an example of which is depicted in FIG. 8, in a receiving direction R (see FIGS. 7, 8). The socket 84 defines the receiving direction to extend parallel the plane of the circuit board 4. The electric plug 9 is connected by an electric line 95, in particular an electric cable, to an electric power source 97 such as a battery, a generator or a combination thereof.

A connection channel 83 (see FIG. 7) extends between an inner end portion 84*b* (i.e. an end portion of the socket 84 distant from the opening in the receiving direction) of the socket 84 and the lower surface 81*b*, 82*b* of the power connector 8. An electric connector 85, such as a metallic (helical) spring, contacting an electrically conducting path 42 formed on or within the circuit board 4 is arranged within the connection channel 83.

When the plug 9 is inserted into the socket 84, an outer periphery 92 of the plug 9 contacts an inner surface 84*a* of the socket 84 establishing a first electric connection.

Further, a tip 94 of the plug 9 contacts the electric connector 85 arranged within the connection channel 83, thereby providing a (second) electric connection between the tip 94 of the plug 9 and the conducting path 42 of the circuit board 4.

The power connector 8 further comprises a second portion 82, which in the exemplary embodiment depicted in the figures is formed integrally with the first portion 81. In alternative embodiments not depicted in the figures, the second portion 82 may be manufactured independently from and then joined with the first portion 81.

The second portion 82 has a second lower surface 82*b*, which is formed flatly with the first lower surface 81*b* of the first portion 81 forming a continuous planar lower surface 81*b*, 82*b* of the power connector 8.

The second portion 82 further comprises a second upper surface 82*a*, which is arranged parallel to the second lower surface 82*b* at a distance $d_2$ from the second lower surface 82*b*. The distance $d_2$ between the second upper surface 82*a* and the second lower surface 82*b* is smaller than the distance $d_1$ between the first upper surface 81*a* and the first lower surface 81*b* ($d_1<d_2$). This results in a step 88 formed between the first and second upper surfaces 81*a*, 82*a*.

The second upper surface 82*a* is configured as a connection surface 82*a*, i.e. for mating with the complementary connection surface 102 of the complementary connection element 10 (cf FIGS. 2 and 3).

A plurality of protrusions 87 and/or openings 89 are formed on and/or within the second portion 82 of the connection surface 82*a*. The positions of the protrusions 87 and/or openings 89 are aligned to match with corresponding openings 110 formed within the complementary connection surface 102 of the complementary connection element 10 (see FIG. 3) resulting in a desired alignment of the complementary connection surface 102 of the complementary connection element 10 with the connection surface 82*a* of the power connector 8.

Fixing elements 115, such as bolts or screws, may extend through the openings 89, 110 for securely fixing the complementary connection element 10 to the power connector 8, as it is depicted in FIGS. 1 and 2.

While the invention has been described with reference to exemplary embodiments, it will be understood by those skilled in the art that various changes may be made and equivalents may be substituted for elements thereof without departing from the scope of the invention. In addition, many modifications may be made to adopt a particular situation or material to the teachings of the invention without departing from the essential scope thereof. Therefore, it is intended that the invention is not limited to the particular embodiments disclosed, but that the invention includes all embodiments falling within the scope of the claims.

The invention claimed is:

1. A power connector for an aircraft solid state power controller, the power connector comprising:

a first portion including a socket configured for receiving an electric plug, which is insertable into the socket in a receiving direction (R); and a second portion comprising a connection surface configured for mating with a complementary connection surface of a complementary connection element;

wherein at least one opening is formed within the connection surface;

wherein the power connector further comprises a connection channel extending between the socket and a lower surface of the power connector, and at least one electric connector arranged within the connection channel for providing an electric connection between the socket and an electrically conducting path, which is formed at the lower surface of the power connector.

2. The power connector according to claim 1, wherein the first and second portions are formed integrally with each other.

3. The power connector according to claim 1, wherein the at least one opening extends between the connection surface and a lower surface of the power connector.

4. The power connector according to claim 1, further comprising at least one protrusion extending from the connection surface.

5. The power connector according to claim 1, wherein the at least one electric connector includes a metallic spring, in particular a helical spring.

6. The power connector according to claim 1, wherein the first portion has a first upper surface and a first lower surface opposite to the first upper surface, and wherein a distance ($d_1$) between the first upper surface and the first lower surface is larger than a distance ($d_2$) between the connection surface and the first lower surface.

7. The power connector according to claim 1, wherein the first portion has a rectangular cross-section, in particular a quadratic cross-section, in a plane which is oriented orthogonally to the receiving direction (R); and/or wherein the socket has a circular cross-section in a plane which is oriented orthogonally to the receiving direction (R).

8. The power connector according to claim 1, wherein the connection surface is a flat connection surface.

9. The power connector according to claim 8, wherein a surface normal of the flat connection surface in particular extends orthogonally to the receiving direction (R).

10. A printed circuit board of an aircraft solid state power controller comprising:

the power connector as claimed in claim 1.

11. The printed circuit board according to claim 10, wherein the connection surface and the complementary connection surface extend in a direction parallel, or essentially parallel, to the plane of the printed circuit board.

12. The printed circuit board according to claim 11, further comprising at least one conducting path electrically connecting with the electric connector arranged within the connection channel.

13. A power connection assembly comprising a power connector and a complementary connection element, the power connector comprising:

a first portion including a socket configured for receiving an electric plug, which is insertable into the socket in a receiving direction (R); and a second portion comprising a connection surface configured for mating with a complementary connection surface of the complementary connection element;

wherein at least one opening is formed within the connection surface;

wherein the complementary connection element comprises:

a complementary connection surface, which is configured for mating with the connection surface formed at the second portion of the power connector; and a backbone which is electrically connected with the complementary connection surface and plurality of connection arms extending from the backbone for distributing electric power from the power connector;

wherein an opening is formed in each of the connection arms allowing fixing elements to extend through the connection arms for securely fixing the connection arms to corresponding electric contacts provided on a circuit board.

14. A circuit board of an aircraft solid state power controller comprising:

electric contacts provided on the circuit board; and the power connection assembly as claimed in claim 13.

* * * * *